US008485374B2

(12) United States Patent
Gevers et al.

(10) Patent No.: US 8,485,374 B2
(45) Date of Patent: Jul. 16, 2013

(54) PLASTIC CLOSURE WITH ENHANCED PERFORMANCE

(75) Inventors: Dave Gevers, Lafayette, IN (US); Pranav M. Bhatt, Crawfordsville, IN (US); Navaneeth Bashyam, Crawfordsville, IN (US); Thomas McCandless, Crawfordsville, IN (US)

(73) Assignee: Closure Systems International, Inc., Indianapolis, IN (US)

( * ) Notice: Subject to any disclaimer, the term of this patent is extended or adjusted under 35 U.S.C. 154(b) by 118 days.

(21) Appl. No.: 12/982,242

(22) Filed: Dec. 30, 2010

(65) Prior Publication Data

US 2011/0163098 A1 Jul. 7, 2011

Related U.S. Application Data

(60) Provisional application No. 61/291,431, filed on Dec. 31, 2009.

(51) Int. Cl.
*B65D 41/04* (2006.01)
*B65D 51/16* (2006.01)

(52) U.S. Cl.
USPC ..... 215/329; 215/339; 215/340; 215/341; 215/343; 215/344; 215/345; 220/288; 220/303; 220/304; 220/366.1

(58) Field of Classification Search
USPC ..... 215/329, 339, 340, 341, 343, 344, 215/345; 220/288, 303, 304, 366.1
See application file for complete search history.

(56) References Cited

U.S. PATENT DOCUMENTS

| | | | | |
|---|---|---|---|---|
| 4,846,361 | A | 7/1989 | Haffner | |
| 5,197,620 | A * | 3/1993 | Gregory | 215/307 |
| 5,836,464 | A | 11/1998 | Druitt | |
| 5,950,850 | A | 9/1999 | Takamatsu et al. | |
| 6,123,212 | A * | 9/2000 | Russell et al. | 215/330 |
| 7,014,055 | B2 * | 3/2006 | Kano et al. | 215/344 |
| 2004/0045926 | A1 | 3/2004 | Williamson | |
| 2005/0211659 | A1 | 9/2005 | Tsutsumi et al. | |
| 2006/0021959 | A1 | 2/2006 | Falzoni | |
| 2006/0138071 | A1 * | 6/2006 | Tsutsumi et al. | 215/252 |
| 2006/0163193 | A1 | 7/2006 | Smeyak et al. | |
| 2009/0045158 | A1 * | 2/2009 | Suriol | 215/256 |

OTHER PUBLICATIONS

International Search Report and Written Opinion for corresponding PCT application No. PCT/US2010/062466 mailed Feb. 28, 2011.

* cited by examiner

*Primary Examiner* — Anthony Stashick
*Assistant Examiner* — Madison L Poos
(74) *Attorney, Agent, or Firm* — Wood, Phillips, Katz, Clark & Mortimer

(57) ABSTRACT

A plastic closure is disclosed which is configured for enhanced performance and reduced closure weight. Notably, the closure includes a compound, internal helical thread formation including an upper retention portion which provides desired closure hoop strength and sealing performance, and a lower guide portion which is configured for light weight while functioning to guide the closure onto an associated container during application. The closure can further include a stepped top wall portion having a relatively thick outer region, and a relatively thin central region. A tamper-evident band of the closure can be configured to include a deformable free edge portion for enhanced tamper-resistance.

4 Claims, 1 Drawing Sheet

PLASTIC CLOSURE WITH ENHANCED PERFORMANCE

TECHNICAL FIELD

The present invention relates, generally to plastic closures formed from polymeric materials such as for use on beverage containers and the like, and more particularly to a plastic closure configured for enhanced sealing and structural performance while minimizing weight, as well as enhanced tamper-resistance.

BACKGROUND OF THE INVENTION

Plastic closures molded from thermoplastic polymeric materials have met with wide spread acceptance in the marketplace for use on containers having beverages and like products. Closures of this type, which can be efficiently formed by compression molding or injection molding, are typically configured for threaded application to associated containers, and are further configured to engage and cooperate with the container to effectively seal the container's contents. Closures of this type may be configured as so-called composite closures, including an outer closure shell, and an inner sealing liner, or as so-called "linerless" closures, wherein the closure shell itself is configured to provide the desired sealing cooperation with the associated container.

While closures of the above type have been very commercially successful, versatile use is promoted by enhancing the sealing and the structural performance of such closures, while at the same type minimizing the quantity of polymeric material required for formation of each molded closure.

Another desirable feature of closures of the above type relates to configuring the closures for tamper-resistance, that is, configuring each closure so as to provide visually discernable and/or audible evidence of partial or complete removal of a closure from an associated container. Typically, closures of this type provide tamper evidence by a section of a side wall or skirt portion of the closure that is easily separable from the main body of the closure. This separable feature is often referred to as the tamper band. The tamper band is typically molded as part of the main body of the closure, but is at least partially detachably connected to the closure by a plurality of frangible connections. These connections (sometimes referred to as leaders or bridges) are designed to provide sufficient strength to avoid disconnection or other damage during de-molding, transportation, and closure application, while being sufficiently weak as to reliably fracture, break, or otherwise deform attendant to removal of the closure from a container by consumers.

An important aspect of tamper band design is a feature intended to permit the tamper band of the closure to be irreversibly applied to an associated container, but to become visibly damaged when the closure is partially or completely removed. Those skilled in the art are familiar with "one-way" features, typically provided in the form of "tabs", "wings", or "nibs". During closure application, these features are "snapped" or otherwise fitted over a mating feature on the container, typically referred to as the "A" diameter. This "A" diameter is a ring that protrudes radially outwardly from the container neck under which the "one-way" feature of the closure tamper band is retained.

Axial clearance (sometimes referred to as "drop space") must be provided between the open end of the tamper band and the "A" diameter feature to allow the separated tamper band to drop away from the remainder of the closure, so that separation is obvious to the consumer. However, a drawback of such designs is that the closure and tamper band can be manipulated in an unauthorized fashion to defeat the tamper-evident function of the tamper band. One manner of defeating the tamper-evidence function entails inserting fingernails or an implement under the tamper band, in the "drop space" between the tamper band the "A" diameter feature of the container, and subsequently removing the closure from the container, either with or without relative rotation of the closure with respect to the container. By manipulation in this fashion, sufficient force can be generated at the open end of the tamper band such that the "one-way" features "such as tabs or wings" will be defeated, either by pulling them out and away from the "A" diameter feature, or by causing them to flip down or bend out of the way.

In view of the above design considerations, it is desirable to provide a plastic closure exhibiting enhanced sealing and structural performance, as well as enhanced tamper-resistance.

SUMMARY OF THE INVENTION

A plastic closure embodiment embodying the principles of the present invention has been particularly configured for enhanced sealing and structural performance, as well as enhanced tamper-resistance. Notably, the present closure is configured to minimize the use of the polymeric material from which it is formed, while still achieving the necessary sealing and structural performance required for effective use on beverage containers and the like. The closure has further been configured for enhanced tamper-resistance, thereby further promoting efficient and versatile use on beverage containers and the like.

In accordance with the illustrated embodiment, the present plastic closure includes a disk-shaped top wall portion, and an annular skirt portion depending from the top wall portion. Notably, the annular skirt portion includes a compound, internal helical thread formation which has been specifically configured to enhance closure performance while minimizing material requirements.

In particular, the thread formation includes an upper retention portion extending continuously about the interior of the closure through about 360°. The helical thread formation further includes a lower guide portion, extending helically from the retention portion toward an open end of the skirt portion of the closure. In order to minimize material requirements for the closure, the lower guide portion of the thread formation has a smaller cross-sectional area than a cross-sectional area of the upper retention portion of the thread formation. In the preferred form, the lower guide portion of the thread formation defines a plurality of circumferentially spaced interruptions to promote venting of gas from within an associated container to which the closure is applied. Most preferably, the circumferentially spaced interruptions defined by the lower guide portion of the thread formation are circumferentially positioned for substantial alignment with vent grooves defined by an associated container when a seal between the closure and the container is opened.

In accordance with the illustrated embodiment, the upper retention portion of the thread formation has a substantially uniform cross-sectional area. By configuring the upper retention portion of the thread formation to extend circumferentially about 360°, the portion of the thread nearest the closed end of the closure is relatively strong and rigid, desirably enhancing the hoop strength of the closure, in comparison to the lower end of the thread formation toward the open end of the closure. The strengthened portion of the thread formation desirably enhances the ability of the closure to resist stripping of the thread formation due to application of excessive torque to the closure, while at the same time desirably permitting a reduction in the thickness and weight of the closure side wall while retaining sufficient strength. The relatively strong retention portion of the thread formation desirably enhances the ability of the closure to maintain the pressure against the seal between the sealing feature of the closure, and the top of the associated container.

In the illustrated embodiment, sealing engagement of the closure with an associated container is effected by the provision of an inner, annular plug seal element depending from the top wall portion for sealing engagement with an inside surface of a container to which the closure is applied. In accordance with the illustrated embodiment, the present closure further includes an outer, annular sealing element depending from the top wall portion, outwardly of the plug seal element, for engagement with a generally outwardly facing surface of a container to which the closure is applied.

By this illustrated arrangement, the outer, annular sealing element provides the primary seal for the closure which seal is formed as the outer sealing element is trapped between a pressure block region of the closure, generally at the juncture of the top wall portion and the skirt portion, and the finish of the associated container, at a fully applied condition. The outer annular sealing element acts as a flexible membrane, with a seal formed at the inner diameter of the sealing element and the container finish, as the outer diameter of the sealing element presses against the pressure block surface.

The inner, annular plug seal element of the closure provides a secondary seal for the closure and container package. This secondary seal can be important during top load venting, and acts as a dynamic seal, and plays an important role in venting at opening of the closure. The secondary seal is preferably sized to be relatively short, shorter than typical plug seal arrangements, to desirably reduce closure weight, and enable faster engagement during top load application. The short sealed side also desirably acts to vent gas from within the associated container early during closure opening, thus aiding the venting of gas pressure as early as possible.

In a preferred embodiment of the present closure, the top wall portion of the closure has two different thickness regions. A relatively thick, outer annular region is generally provided at the "shoulder" of the closure and provides the region of the top wall portion from which both the inner and outer sealing elements depend.

In contrast, a relatively thin, central region of the top wall portion is positioned inwardly of the outer annular region. The junction or step between the relatively thin and relatively thick regions acts as a point of inflection as the top wall portion of the closure "domes" i.e. deforms outwardly, under the influence of internal gas pressure. The relatively thin region domes more than the doming typically exhibited by a conventional closure. In contrast, the internal pressure has minimal effect on doming of the relatively thick top panel region due to the step in the top panel. By this arrangement, closure sealing is minimally affected by the doming and internal pressure. When subjected to a top load, this configuration of the closure results in deflection only at the center region of the top panel, and has only a small effect on the relatively thick, outer annular region of the top panel. The sealing elements are also minimally affected by the top panel configuration. This desirably results in a light weight top panel design that performs better than the typical top panel configuration, having a uniform thickness, at conventional carbonated soft drink gas pressures and top load venting performance.

As noted, closures of the present type are preferably provided with a tamper-evident feature to alert consumers to unauthorized manipulation of the closure. To this end, the present closure can be configured to include a tamper-evident band depending from and at least partially detachably connected to the skirt portion of the closure. Notably, the tamper-evident band includes an annular band portion, and a relatively thin, deformable tamper ring depending from a lower edge of the annular band portion. The tamper ring is readily deformable if subjected to unauthorized manipulation, and thus provides a visually discernible evidence of manipulation to defeat the tamper-evident band.

Other features and advantages of the present invention will become readily apparent from the following detailed description, the accompanying drawings, and the appended claims.

DETAILED DESCRIPTION OF THE INVENTION

Figure 1:
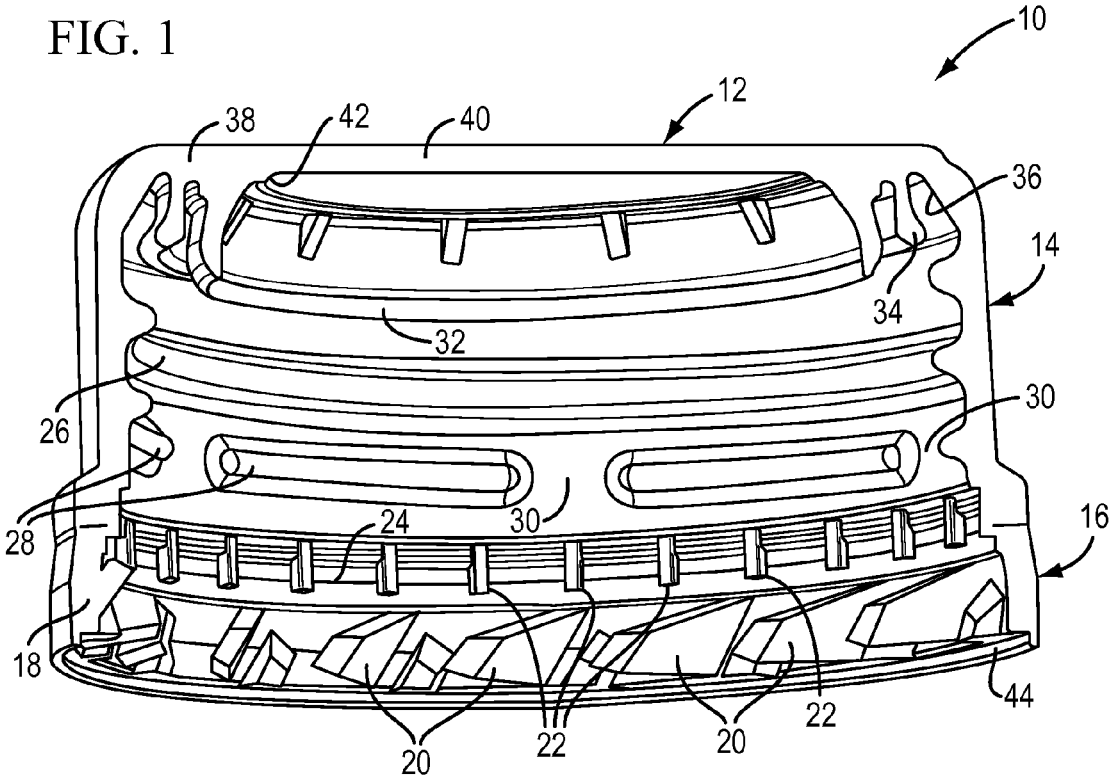
FIG. 1 is a cross-section view of a closure embodying the principles of the present invention.
Figure 2:
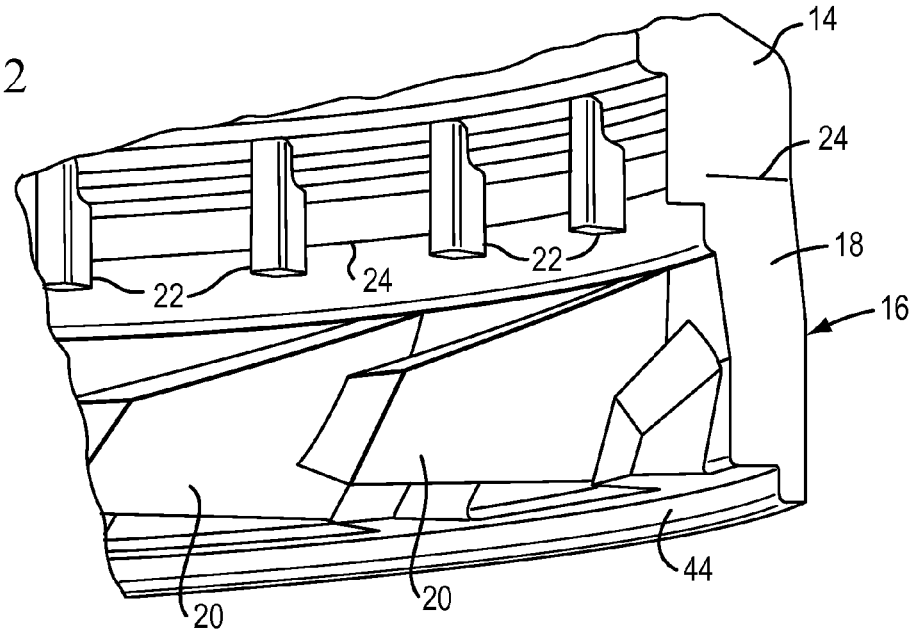
FIG. 2 is a relatively enlarged, fragmentary perspective view of a portion of the closure illustrated in FIG. 1.

While the present invention is susceptible of embodiment in various forms, there is shown in the drawings and will hereinafter be described a presently preferred embodiment, with the understanding that the present disclosure is to be considered as an exemplification of the invention and is not intended to limit the invention to the specific embodiment illustrated.

With reference now to the drawings, there is illustrated a plastic closure 10 embodying the principles of the present invention. Closure 10 can be efficiently formed by compression molding or injection molding techniques, as are known in the art, and can be formed from suitable polymeric, thermoplastic materials. As will be further described, closure 10 is illustrated in a one-piece linerless configuration, configured for sealing cooperation with an associated container, but it will be understood that features of the present invention can be readily adapted for so-called composite closures, including a separate sealing liner positioned within an outer closure shell.

In accordance with the illustrated embodiment, closure 10 is generally cup-shaped and includes a top wall portion 12, and annular skirt portion 14 depending from the top wall portion. As will be further described, the annular skirt portion 14 includes a compound, helical thread formation on the inside surface thereof, for threaded engagement and cooperation with an external helical thread formation of a bottle or other container to which the closure is applied.

In order to provide evidence of partial or complete removal of the closure 10 from an associated container, the closure includes a tamper-evident band 16 which is at least partially detachably connected to annular skirt portion 14. In the illustrated embodiment, tamper-evident band 16 includes an annular band portion 18 from which inwardly extend a plurality circumferentially spaced, relatively flexible projections or "wings" 20. These projections cooperate with the associated container after the closure 10 is fully applied to the container, such that during closure removal, the projections cooperate with the container to at least partially detachable connect the tamper-evident band 16 from the skirt portion 14.

To this end, a frangible connection is provided between the tamper-evident band 16 and the skirt portion 14. In the illustrated embodiment, the frangible connection is provided by a plurality of circumferentially spaced, rib-like bridges 22 which extend between the inside surfaces of the skirt portion 14 and annular band 18 of tamper-evident band 16. The skirt portion 14 and tamper-evident band 16 are distinguished from each other from circumferentially extending score line 24 which extends between the skirt portion and the tamper-evident band to separate the two, with the score line extending at least partially into some of the bridges 22, whereby the bridges provide the desired frangible connection between the skirt portion and the tamper-evident band.

In accordance with the present invention, closure 10 includes a compound, helical internal thread formation including an upper retention portion 26, and a lower guide portion provided by a plurality of circumferentially spaced thread segments 28. The thread formation of closure 10 is compound in the sense that different portions of the thread formation have been specifically configured for the necessary performance requirements of the closure, while at the same time permitting the closure to be desirably configured for reduced weight.

In particular, the upper retention portion 26 of the thread formation extends continuously about the interior of the closure through about 360°, thus desirably enhancing the strength and rigidity of the closure, sometimes referred to as hoop strength. This strengthened portion of the closure desirably acts to increase the ability of the closure to resist stripping of the thread due to application of excessive torque to the closure, such as during closure application, while at the same time desirably permitting the thickness and weight of the skirt portion 14 of the closure to be reduced. The upper retention portion of the thread formation desirably acts to enhance the ability of the closure to maintain the pressure of the closure against an associated container for effective sealing.

In accordance with the illustrated embodiment, the upper retention portion 26 of the thread formation extends continuously, without interruption, around the interior of the closure 10, with the upper retention portion of the thread formation having a substantially uniform cross-sectional area throughout its length.

In accordance with the present invention, the helical thread formation of the closure 10 further includes a lower guide portion, which in the illustrated embodiment is provided by the circumferentially spaced thread segments 28. Notably, the lower guide portion of the thread formation has a smaller cross-sectional area than the cross-sectional area of the upper retention portion, thus permitting the lower guide portion to perform the necessary guiding function as the closure is applied to an associated container, such as during initial application, as well as during reapplication by consumers. By providing the lower guide portion with a smaller cross-sectional area, weight savings are desirably achieved, without compromise to the performance characteristics of the closure.

In the illustrated embodiment, the thread segments 28 of the lower guide portion of the thread formation define a plurality of circumferentially spaced interruptions 30 to promote the venting of gas from within an associated container to which the closure is applied. In the preferred form, the interruptions 30 defined by the lower guide portion of the thread formation are circumferentially positioned for substantial alignment with vent grooves defined by an associated container when a seal between the closure and the container is opened. Thus, the interruptions provide the desired pathways for gas to escape from within the container at the time of opening, thus promoting venting of the greatest volume of gas in the shortest amount of time.

Thus, as will be appreciated, the thread interruptions 30 are placed so that none of the interruptions are in effect until the closure is unscrewed to the point of releasing trapped gas by opening the seal of the closure. Further, the thread interruption 30 are placed in such positions that they are grouped near the point at which they would interact with vents (i.e. interruptions) in the container finish, and thus provide the maximum path of escape for internally trapped gas in the container at the angle of rotation at which the seal starts to open. At the same time, the thread interruptions 30 are preferably spaced in such positions that minimize the volume and mass of the lower guide portion of the thread formation, which functions for guiding the closure onto the container finish threads during application.

As noted, closure 10 is configured as a so-called linerless closure, and to this end, includes features for effecting sealing engagement with an associated container, without resort to a separate sealing liner or the like. In particular, the closure 10 includes an inner, annular plug seal element 32 depending from the top wall portion 12 of the closure for sealing engagement with an inside surface of a container to which the closure is applied. The closure 10 further includes an outer, annular sealing element 34 depending from the top wall, outwardly of the plug seal 32, for engagement with a generally outwardly facing surface of the container to which the closure is applied. The annular sealing element 34, sometimes referred to as a "tonsil" seal by virtue of its pendant-like cross-sectional configuration, is intended as the primary seal for the closure, and acts in cooperation with a pressure block region 36 formed generally at the inside surface of the junction of the top wall portion 12 and skirt portion 14 of the closure. This sealing configuration, wherein the seal element 34 is trapped between the pressure block region 36, and the outside surface of an associated container, can be particularly effective for use with carbonated soft drinks, which exert internal gas pressure against the inside surface of the top wall portion of the closure. Attendant to the application of such pressure, plastic closures typically exhibit an effect referred to as "doming", as the top wall portion of such a closure is subjected to cold flow or "creep" under the influence of the internal gas pressure. In the present closure construction, under the influence of internal gas pressure, the annular seal element 34 is urged into enhanced sealing engagement with the associated container.

In accordance with the illustrated embodiment, enhanced sealing performance, as well as reduction in closure weight, is achieved by configuring top wall portion 12 to include a relatively thick, outer annular region 38, and a relatively thin, central region 40 positioned inwardly of outer annular region 38. As would be observed, annular plug seal element 32, and the outer, annular sealing element 34 depend from the relatively thick out annular region 38 of the top wall portion 12.

By this illustrated embodiment, the relatively thick annular region 38 is provided at the "shoulder of the closure" which supports the plug seal 32 and the outer seal 34, with the thinner panel region positioned inwardly of the relatively thick outer region. The junction or step 42 between the thin and thick regions of the top wall portion acts as a point of inflection as the closure domes due to internal pressure. The thin region domes more than a typical conventional closure. The internal gas pressure has minimal effect on doming of the relatively thick panel region due to the step 42 at the top wall portion 12.

Thus, the varying top panel design enables the closure sealing to be minimally affected by the doming and internal pressure. By this design, when a top load is applied, only the center portion of the top wall portion deflects, with a reduced effect at the relatively thick top wall region. Thus, the seals of the closure are also minimally affected by such deflection of the top wall portion. As a consequence, the light weight top wall portion of the closure has been found to offer better sealing performance than a conventional closure having a uniform top wall portion thickness, attendant to sealing a carbonated soft drink pressure levels and top load venting performance.

As noted above, the closure 10 in the illustrated embodiment is configured for tamper-evidence by the inclusion of tamper-evident band 16. However, it has been recognized that tamper-resistance can be compromised by unauthorized manipulation of a closure, which manipulation can be effected at the free edge of the closure at the lower end of tamper-evident band 16.

Thus, in accordance with the present invention, tamper-resistance is enhanced by the provision of a relatively thin, deformable tamper ring 44 depending from a lower edge of the annular band portion 18 of the tamper-evident band. The tamper ring 44 is configured to be readily deformable to provide visually discernable evidence of manipulation to defeat the tamper-evidence band.

By the provision of the tamper ring 44, the closure provides a clear indication to the user that an axial, radial or tangential force has been applied to the open end of the closure. The provision of the tamper ring irreversibly indicates to the user any attempt at defeating the primary tamper-evident feature of the closure. The tamper ring is configured to have an appropriate of axial length to radial thickness so that forces incurred during an attempt to defeat the primary tamper-evident feature will cause obvious and irreversible indication, either by color change or deformation.

From the foregoing, it would be observed that numerous modifications and variations can be effected without departing from the true spirit and scope of the novel concept of the present invention. No limitation with respect to the specific embodiment illustrated herein is intended or should be inferred. The disclosure is intended to cover by the appended claims all such modifications which fall within the scope of the claims.

What is claimed is:

1. A plastic closure, comprising:

a top wall portion;

an annular skirt portion depending from said top wall portion, and a tamper-evident band depending from and at least partially detachably connected to said skirt portion of said closure, said annular skirt portion including a compound, internal helical thread formation, wherein said thread formation includes an upper retention portion extending continuously about the interior of the closure through about 360 degrees, and further includes a lower guide portion, extending helically from said retention portion toward an open end of said skirt portion, said internal thread formation being positioned above said tamper-evident band, said lower guide portion of said thread formation having a smaller cross-sectional area than a cross-sectional area of said upper retention portion of said thread formation, wherein said lower guide portion of said thread formation defines a plurality of circumferentially spaced interruptions to promote the venting of gas from within an associated container to which said closure is applied.

2. A plastic closure in accordance with claim 1, wherein said upper retention portion of said thread formation has a substantially uniform cross-sectional area.

3. A plastic closure in accordance with claim 1, wherein said closure includes an inner, annular plug seal element depending from said top wall portion for sealing engagement with an inside surface of a container to which said closure is applied, and an outer, annular sealing element depending from said top wall portion outwardly of said plug seal element for engagement with a generally outwardly facing surface of the container to which said closure is applied, said top wall portion of said closure including a relatively thick, outer annular region from which said inner plug seal element and said outer sealing element depend, and a relatively thin, central region positioned inwardly of said outer annular region.

4. A plastic closure in accordance with claim 1, wherein said tamper-evident band includes an annular band portion, and a relatively thin, deformable tamper ring depending from a lower edge of said annular band portion, said tamper ring being deformable to provide visually discernible evidence of manipulation to defeat said tamper-evident band.

* * * * *